United States Patent [19]

Hackman

[11] Patent Number: 4,518,327

[45] Date of Patent: May 21, 1985

[54] ROTARY PERISTALTIC PUMP

[76] Inventor: Charles H. Hackman, 195 Holden St., North Fitzroy Vic. 3068, Australia

[21] Appl. No.: 522,160

[22] PCT Filed: Nov. 23, 1982

[86] PCT No.: PCT/AU82/00195

§ 371 Date: Jul. 25, 1983

§ 102(e) Date: Jul. 25, 1983

[87] PCT Pub. No.: WO83/01984

PCT Pub. Date: Jun. 9, 1983

[30] Foreign Application Priority Data

Nov. 25, 1981 [AU] Australia ..... 01688/81

[51] Int. Cl.[3] ..... F04R 43/12

[52] U.S. Cl. ..... 417/477

[58] Field of Search ..... 417/477, 476, 475

[56] References Cited

U.S. PATENT DOCUMENTS

| | | | |
|---|---|---|---|
| 2,831,437 | 4/1958 | Cromwell et al. | 417/477 |
| 2,987,004 | 6/1961 | Murray | 92/90 X |
| 3,105,447 | 10/1963 | Ruppert | 417/475 |
| 3,249,059 | 5/1966 | Renn | 417/477 |
| 3,649,138 | 3/1972 | Clay et al. | 417/477 |
| 4,138,205 | 2/1979 | Wallach | 417/360 |

FOREIGN PATENT DOCUMENTS 8102331 8/1981 Int'l. Prop. Org. .

*Primary Examiner*—Richard E. Gluck

*Attorney, Agent, or Firm*—Armstrong, Nikaido, Marmelstein & Kubovcik

[57] ABSTRACT

A rotary peristaltic pump comprises a rotor member (4) fitted in a stator member (5) and coupled to a motor (2) and having a cylindrical head section (6) housing a plurality of pump tube compressing idler rollers (7) equidistantly radially disposed around the head section, with their longitudinal axes parallel to the axis of the head section. The rollers are positioned in an annular recess (8) in the periphery of the head section, the root periphery of the recess being grooved (17) to accept each compressing idler roller such that a substantial part of each roller protrudes into the annular recess. The stator member (5) comprises a base section (9) and wall section (10) defining an axial opening (11) to accommodate the cylindrical head section and has pump tube entry ports (12, 13) in the wall (10) for tangential communication with the annular recess. Stator member (5) may slide along the rotor shaft (31) to facilitate service to the rotor elements and tube. Rotor member (4) may also include pump tube stabilizing idler rollers in the annular recess and a magnetic element to facilitate pump control in conjunction with an electronic control circuit.

20 Claims, 11 Drawing Figures

ROTARY PERISTALTIC PUMP

BACKGROUND OF THE INVENTION

This invention relates to rotary peristaltic pumps, suitable for miniaturisation, the pump of the invention having a high degree of efficiency and accuracy, making it particularly suitable for medical drugs administration. For example, the pump of the invention is especially suitable for the infusion of insulin or other drugs into ambulant patients, and by reason of its preferred materials of construction as hereinafter described, the pump of the invention is also suitable for use in corrosive environments. However, such uses are merely illustrative and non-limitative.

Previous constructions of rotary peristaltic pumps for medical drug administration have suffered from one or more disadvantages, namely, (a) excessive size and complexity; (b) dependence upon very close tolerances in components subject to wear or warping; (c) susceptibility to the presence of dirt and corrosion; (d) inability to tolerate high temperatures, e.g. sterilisation; (e) high frictional losses and power requirements; (f) excessive wear of pump-tubing; and (g) poorly reproducible delivery volumes or rates.

Thus, previous rotary peristaltic pumps have been constructed with compression rollers held in a cage by bearing pins. The driving force is transmitted either via a cage which is mounted on the driving shaft (hereinafter referred to a rotary peristaltic pump "Type A"), or via a central shaft or roller whose rotation is transmitted to the compression rollers by direct contact, so that the cage travels more slowly than the driving shaft (hereinafter referred to as rotary peristaltic "Type B").

Rotary peristaltic pump "Type A" requires rigid bearing pins to secure the compression rollers to the cage and these bearings are susceptible to wear and seizing. Wear results in failure adequately to compress the tubing, resulting in loss of accuracy and pump failure. Seizing results in erratic operation and excessive wear of pump tubing.

Two modifications of rotary peristaltic pump "Type A" exist, which seek to overcome the problems occasioned by wear, namely, (1) omission of the outer race, which is identified as the 'Holter' pump, the tubing merely being stretched over the rollers, resulting in an extremely pulsatile flow with considerable flow reversal, moreover, the pump can only maintain constant mean flow rates at low inlet and outlet pressures, and (iii) spring mounting of the rollers or of a segment of the outer race, which is more satisfactory in operation but is complex and often bulky.

Rotary peristaltic pump "Type B" is not dependent on a rigid cage and close tolerance bearing between the cage and the compression rollers. However, the cage generally requires a separate central bearing and this is very sensitive to the least unevenness in the roller from wear or the presence of dirt, which rapidly results in erratic operation, heavy wear and consequent pump failure, this problem being exacerbated by miniaturisation.

The rotary peristaltic pump of the present invention avoids many of the above problems, in particular, by being compact and eminently suitable for miniaturisation; by having very low power requirements; by being of considerably simpler construction and thus easy to manufacture; by being less susceptible to failure through wear or seizing; by being capable of great accuracy, especially at low flow rates; and by not requiring lubrication due to selection of the materials of construction.

SUMMARY OF THE INVENTION

In accordance with the present invention, there is provided a rotary peristaltic pump adapted to be fitted with motor drive means and pump tubing for connection to a source of fluid, said pump comprising:

A rotor member adapted for operative coupling to the motor drive means and having a circular head section housing a plurality of pump-tubing-compressing idler rollers in approximately equidistant radially disposed positions for idle rotation axially parallel to the axis of rotation of the rotor member in the course of rotation of said rotor member, said circular head section having inner flange member and an outer flange member joined in spaced-apart relationship by an axial cylindrical mid-section so as to form a circumferential recess defining a race compartment for the pump tubing-compressing idler rollers, said pump tubing-compressing idler rollers positioned between said inner flange member and outer flange member for idle rotation axially parallel to the axis of rotation of the rotor member by the opposite ends of each said pump tubing-compressing idler roller engaging in recess bearings in the inner flange member and outer flange member respectively, and a minor portion of the circumferential face of each said pump tubing-compressing idler roller disposed in an axially parallel idler roller thrust-bearing groove in the circumferential face of said axial cylindrical mid-section, with the major portion of the circumferential face of each said pump tubing-compressing idler roller protruding into said race compartment; and a stator member having a base section and a wall section with inner faces which define an axial opening for accommodating the circular head section of the rotor member and having pump tubing entry and exit ports in the wall section for tangential communication with said race compartment of the rotor member;

said pump tubing being fitted to the pump by loading into the race compartment via said pump tubing entry port, then passing around the race compartment to exit therefrom via said pump tubing exit port, whereby the portion of the pump tubing in said race compartment is successively contacted by the protruding circumferential faces of the pump tubing-compressing idler rollers in the course of rotation of said rotor member and is thereby compressed between said inner face of the stator member wall section and said circumferential faces of the pump tubing-compressing idler rollers to effect peristaltic pumping of fluid in said pump tubing, and the circumferential faces of the pump tubing-compressing idler rollers engaging the axially parallel roller thrust-bearing grooves in the circumferential face of the axial cylindrical mid-section so as to minimize axial flexural deformation of each pump tubing-compressing idler roller induced by compression of the pump tubing.

Said inner flange member and outer flange member and axial cylindrical mid-section of the circular head section of the rotor member may also house a plurality of pump tubing-stabilizing idler rollers in approximately equidistant radially disposed positions in between the approximately equidistant radially disposed positions of the pump tubing-compressing idler rollers of idle rotation axially parallel to the axis of rotation of the rotor member in the course of rotation of said rotor member, said pump tubing-stabilizing idler rollers positioned between said inner flange member and outer flange member for idle rotation axially parallel to the axis of rotation of the rotor member by the opposite ends of each said pump tubing-stabilizing idler roller engaging in recess bearings in the inner flange member and outer flange member respectively, and a major portion of the circumferential face of each said pump tubing-stabilizing idler roller disposed in an axially parallel roller thrust-bearing groove in the circumferential face of said axial cylindrical mid-section, with the minor portion of the circumferential face of each said pump tubing-stabilizing idler roller protruding into said race compartment, whereby the portion of the pump tubing in said race compartment is successively contacted by the protruding circumferential faces of the pump tubing-stabilizing idler rollers in the course of rotation of said rotor member so as to be frictionally restrained between said inner face of the stator member wall section and said circumferential faces of the pump tubing-stabilizing idler rollers for countering a tendency of the pump tubing to move within said race compartment.

The circumferential face of said axial cylindrical mid-section may have axially parallel arcuate grooves corresponding to the number of pump tubing-compressing idler rollers and conforming with the diameter of each said pump tubing-compressing idler roller for the minor portion of the circumferential face of each said pump tubing-compressing roller to engage and bear against said axial cylindrical mid-section, with the major portion of the circumferential face of each said pump tubing-compressing roller protruding into said race compartment. Also, the circumferential face of said axial cylindrical mid-section may have axially parallel arcuate grooves corresponding to the number of pump tubing-stabilizing idler rollers and conforming with the diameter of each said pump tubing-stabilizing roller so that a major portion of the circumferential face of each said pump tubing-stabilizing roller bears against said axial cylindrical mid-section and a minor portion of the circumferential face of each said pump tubing-stabilizing roller protrudes into said race compartment.

Said rotor member may be slideably fitted to said stator member so as to be displaceable axially but not radially of the stator member through a co-axial bearing in said base section of the stator member for accommodating a drive shaft section of the rotor member, the length of said drive shaft section being such that the rotor member can be displaced axially of the stator member sufficiently to give access to the pump tubing-compressing idler rollers, and the pump tubing-stabilizing idler rollers if utilized, and the part of the pump tubing in said race compartment for inspection and/or adjustment and/or replacement of any of said idler rollers and the pump tubing.

PREFERRED EMBODIMENTS OF THE INVENTION

According to a first practical form of the preferred embodiment of the invention, said inner flange member and outer flange member may be integral with the axial cylindrical mid-section, the inner flange member having approximately equidistant radially disposed recesses forming end-seating cavities for inner ends of said plurality of pump tubing-compressing idler rollers, the outer flange member having corresponding approximately equidistant radially disposed apertures forming end-bearing openings for outer ends of said plurality of pump tubing-compressing idler rollers, and an outer end plate removably connected to the outer flange member for retaining said plurality of pump tubing-compressing idler rollers in said inner end-seating cavities and said outer end-bearing openings. The opposite ends of each pump tubing-compressing roller may be conically pointed, and corresponding bearing faces of said inner end-seating cavities and of said outer end plate may be flat.

According to a second practical form of the preferred embodiment of the invention, said inner flange member may be integral with the axial cylindrical mid-section and the outer flange member is a disc member non-integral with the axial cylindrical mid-section, the inner flange member having approximately equidistant radially disposed recesses forming end-seating cavities for inner ends of said plurality of pump tubing-compressing idler rollers, the disc member having corresponding approximately equidistant radially disposed reccesses forming end-seating cavities for outer ends of said plurality of pump tubing-compressing idler rollers, and said disc member being removably connected to said axial cylindrical mid-section for retaining said plurality of pump tubing-compressing idler rollers in said inner end-seating cavities and said outer end-seating cavities. The opposite ends of each pump tubing-compressing roller may be conically pointed and corresponding bearing faces of said inner end-seating cavities and said outer end-seating may be flat.

In the case where the circular head section of the rotor member also houses a plurality of pump tubing-stabilizing idler rollers, it is preferred that the inner flange member and the outer flange member are integral with the axial cylindrical mid-section, the inner flange member having approximately equidistant radially disposed recesses forming end-seating cavities for inner ends of said plurality of pump tubing-compressing idler rollers and for inner ends of said plurality of pump tubing-stabilizing idler rollers, the outer flange member having corresponding approximately equidistant radially disposed apertures forming end-bearing openings for outer ends of said plurality of pump tubing-compressing idler rollers and for outer ends of said plurality of pump tubing-stabilizing idler rollers, and an outer end plate removably connected to the outer flange member for retaining said plurality of pump tubing-compressing idler rollers and pump tubing-stabilizing idler rollers in said inner end-seating cavities and said outer end-bearing openings.

The opposite ends of each pump tubing-stabilizing roller may be conically pointed, as may the opposite ends of each pump tubing-compressing roller and corresponding bearing faces of said inner end-seating cavities and of said outer end plate may be flat. Also, the circumferential face of each pump tubing-stabilizing idler roller may have a concave contour substantially corresponding to the diameter of the pump tubing.

Said circular head section of the rotor member may be integral with a drive shaft section of the rotor member which is adapted to be removably fitted to said motor drive means. Alternatively, said circular head section may be non-integral with a drive shaft section of the rotor member, which is adapted to be removably connected to the circular head secton and adapted to be removably fitted to said motor drive means.

In the case where the circular head section is integral with a drive shaft section of the rotor member, a magnet may be incorporated in said drive shaft section for position sensing in conjunction with means statically mounted for accurate metering and control of delivered volume, and for limitation of axial movement of said rotor member to prevent disassembly during replacement of pump tubing, and for axial and angular location of a motor drive means shaft into said drive shaft section of the rotor member.

In the case where the circular head section is nonintegral with a drive shaft section of the rotor member, a magnet may be incorporated in the drive shaft section for position-sensing in conjunction with means statically mounted for accurate metering and control of delivered volume, and for limitation of axial movement of the rotor to prevent disassembly during replacement of pump tubing.

Said drive shaft section of the rotor member may comprise a torque transfer member removably connected to the circular head section of the rotor member and removably fitted to a motor drive means shaft. The torque transfer member of said drive shaft section may be in the form of a cylindrical having an axially disposed spindle and adapted for removable connection to said motor drive means shaft and for removable connection to said drive shaft section of the rotor member, said axially disposed spindle adapted to be inserted into a corresponding axially disposed cavity in the circular head section of the rotor member for removable connection of the torque transfer member to said circular head section.

Both the rotor member and the idler rollers are conveniently fabricated from polytetra fluoroethylene (PTFE) resin, while the stator member is conveniently fabricated from either polyacyl or polycarbonate resin, as is the idler roller retaining outer end plate when so utilised. The pump tubing is usually fabricated from silicone rubber and may be moulded into a medical drug reservoir. In a pump assembled from a total of six components, that is, the stator member, the rotor member, three idler rollers, and an idler roller-retaining end plate, only the stator member and the rotor member require accurate machining. The machining tolerances are generally such as to provide a clearance between the stator member wall section and the periphery of the rotor member of 0.03 mm $\pm$0.02 mm.

The idler rollers can be conveniently fabricated from PTFE cylindrical rod, with their ends machined to 150° cones so as to serve as end thrust bearings. They are a loose fit in slightly oversize cavities drilled and/or milled in the circular head section of the rotor member. The idler rollers are retained in the cavities by the closed ends of the cavities in the circular head section of the rotor member and in the outer end plate removably fixed to the outer end of said circular head section or in the non-integral outer flange member of the circular head section. Since the circumferential faces of the idler rollers are in contact throughout their length with the arcuately recessed axial cylindrical mid-section of the circular head section, a large low-load PTFE-PTFE bearing surface is provided through which is transmitted the thrust to compress the pump tubing.

When three (3) pump tubing-compressing idler rollers are utilized, the cavities for said idler rollers are spaced at 120° intervals radially from the axis of the rotor member, conveniently in such a manner that the distance between the inner surface of each cavity and the race compartment, minus the diameter of the idler roller, is 1.9$\pm$0.05$\times$ the thickness of the wall of the pump tubing. This ensures positive occlusion of the pump tubing by the pump tubing-compressing idler rollers.

When loaded into the pump of the invention, the pump tubing lies in the race compartment formed by said circumferential recess in the circular head section of the rotor member and the inner face of the stator member wall section, for compressing by the pump tubing-compressing idler rollers against said inner face of the stator member wall section. Since the sliding friction of silicone rubber is high, while that of a PTFE-PTFE bearing is low, there is little tendency for the pump tubing to move in the race compartment in the case of relatively small diameter tubing for medical drug infusion. Instead, the pump tubing-compressing idler rollers generally roll along the pump tubing as desired, however, in the case of larger diameter such tubing, it is advantageous to employ a plurality of pump tubing-stabilizing idler rollers as indicated above.

Loading or unloading of the pump tubing can be effected by inserting the pump tubing into or removing the pump tubing from the stator member/rotor member assembly, respectively, by sliding the rotor member axially so that the outer flange of the rotor member head section clears the race compartment by at least the diameter of the pump-tubing, thus exposing said circumferential recess and the idler rollers around which the pump-tubing has passed.

Said stator member is not subject to any significant degree of wear, since the thrust is substantially absorbed by the pump tubing, which is stationary. Similarly, provided there are at least three (3) pump tubing-compressing idler rollers, there is little load on the inner and other flange member of the rotor member or the drive shaft section of the rotor member or the bearing surfaces of the stator member, consequently there is little wear or friction. The only surfaces subject to frictional load are those of the bearing between the idler rollers and the rotor member, however, as these are fabricated from PTFE and the load is spread over a relatively large area, then deformation/friction/wear are insignificant.

The magnet which may be connected to the rotor member drive shaft after assembly of the pump, generally serves the threefold purpose of: (a) position sensing in conjunction with reed or Hall effect switches statically mounted, for accurate metering and control of delivered volume; (b) limitation of axial movement of the rotor member to prevent disassembly during change of pump tubing; and (c) axial and angular location of the shaft in the rotor member for connection to a drive motor gearbox assembly.

An important feature of the rotary peristaltic pump according to the invention is that in contrast to such pumps of the prior art, the pump tubing-compressing rollers are not fixed to the rotor member by bearing pins but instead are idly housed in cavities suitably machined in the circular head section of the rotor member for the purpose. The difference in diameter between the idler rollers and their cavities in the rotor member, combined with the elastic properties of the PTFE under compressive load, allow both low friction and wear the adequate compression of pump tubing, despite comparatively wide machining tolerances.

Another important feature of the pump according to the invention is the simplicity of the design, which is increased by the several functions performed by the rotor and stator members, so that apart from the decreased need for close machining tolerance, there is a considerable reduction in the number of components. Thus, in a three (3) pump tubing-compressing idler roller pump according to the invention, the total number of components is six (6) and the number of accurate machining operations required is seven (7), whereas for a corresponding "Type A" pump of the prior art, the minimum numbers are eight (8) and fifteen (15), respectively, whilst for a corresponding "Type B" pump of the prior art, the numbers are nine (9) and seventeen (17), respectively.

PRACTICAL EMBODIMENT OF THE INVENTION

The rotary peristaltic pump of the invention will now be described with reference to the illustrations of FIGS. 1-8 of the accompanying drawings, which depict several embodiments of a medical drug infusion pump for long-term treatment of ambulant patients, a magnet being fitted to the rotor member drive shaft in such a manner as to provide both an end-stop for rotor advancement and location of the motor drive shaft, as well as to actuate electronic control circuitry. In said drawings.

Figure 9:
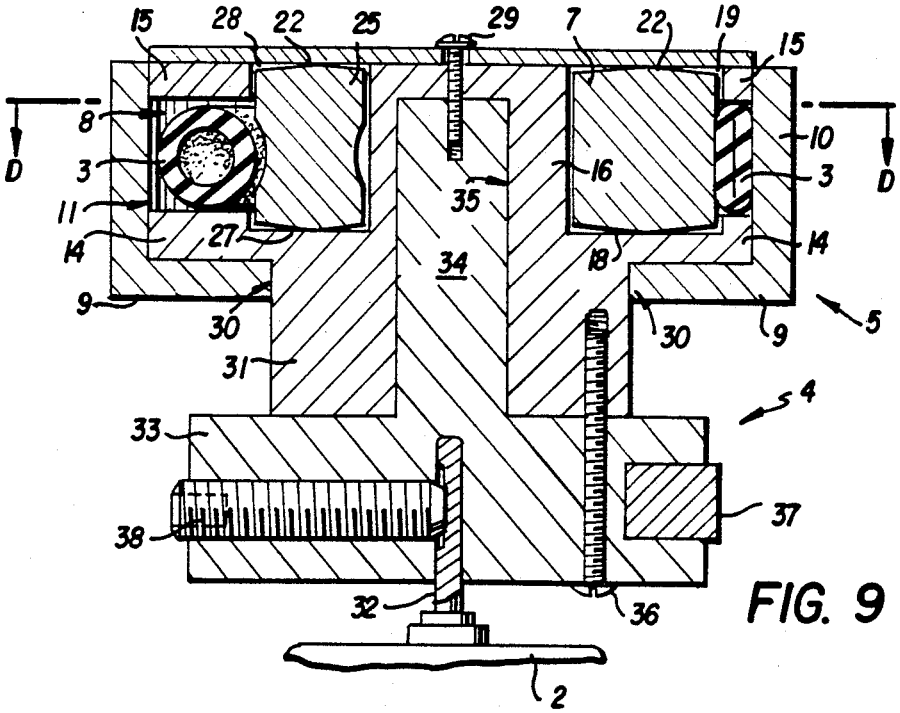
Figure 10:
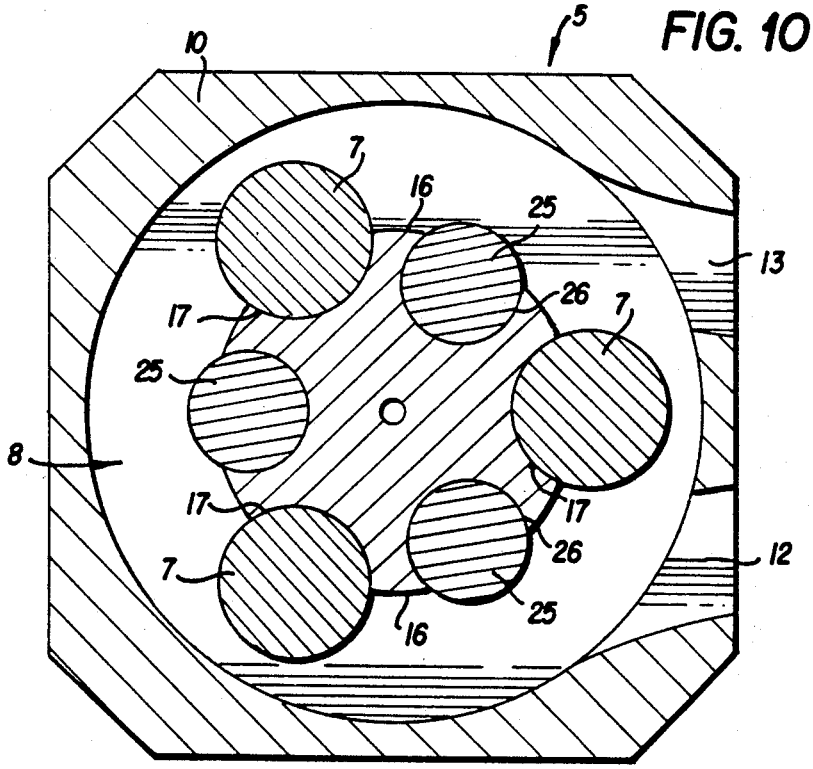

FIG. 9 is a part cross-sectional/part elevational view of the pump assembly, in operative relationship, in which the circular head section of the rotor member houses a plurality of pump tubing-stabilizing idler rollers as well as a plurality of pump tubing-compressing idler rollers, and also showing the drive shaft section of the rotor member with a torque transfer member in the form of a cylinder removably connected thereto, the cylinder having an axially disposed spindle removably connected to the circular head section of the rotor member;

FIG. 10 is a cross-sectional view taken at line D—D of FIG. 9; and

Figure 11:
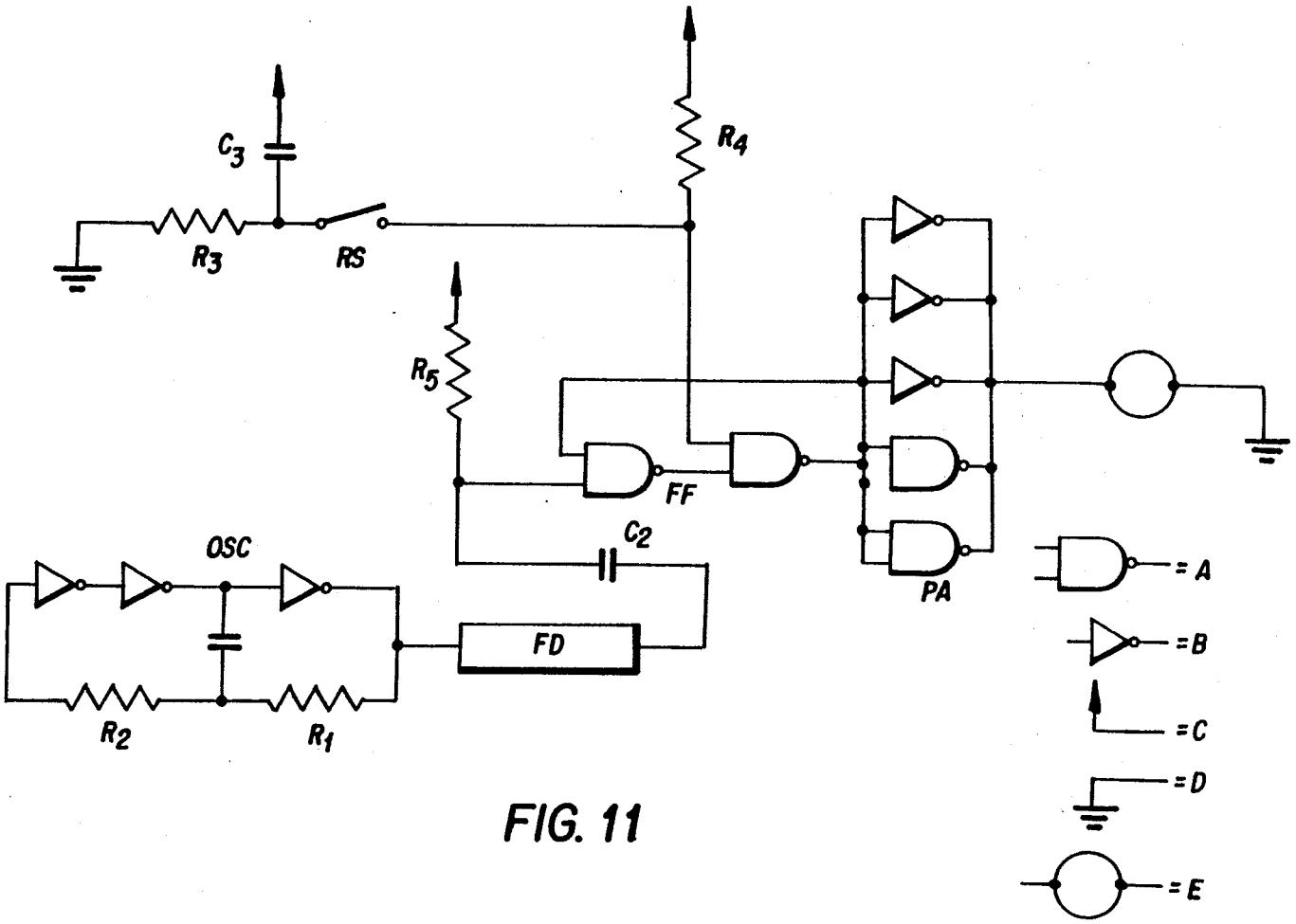

FIG. 11 is a diagrammatic representation of an electronic circuit for the intermittent operation of electric motor drive means for the pump assembly of the invention.

Referring to the drawings, the pump 1 of the invention, which is adapted to be fitted with motor drive means 2 and pump tubing 3, comprises a rotor member 4 and a stator member 5. The rotor member 4 is operatively coupled to the motor drive means 2 and has a circular head section 6 housing a plurality of pump tubing-compressing idler rollers 7 in approximately equidistant radially disposed positions for idle rotation axially parallel to the axis of rotation of the rotor member 4 in the course of rotation of said rotor member. A circumferential recess 8 in the circular head section 6 defines a race compartment for the pump tubing-compressing idler rollers 7 so that a substantial part of the circumferential face of each pump tubing-compressing idler roller 7 protrudes into the race compartment. The stator member 5 has a base section 9 and a wall section 10 with inner faces which define an axial opening 11 for accommodating the circular head section 6 of the rotor member 4, and has pump tubing entry and exit ports 12, 13 in the wall section 10 for tangential communication with said race compartment of the rotor member 4.

FIGS. 1 to 8 of the drawings show the circular head section 6 of the rotor member 4 as comprising an inner flange member 14 and an outer flange member 15 joined in spaced-apart relationship by an axial cylindrical mid-section 16 so as to form said circumferential recess 8 defining the race compartment, said inner flange member 14 and outer flange member 15 and axial cylindrical mid-section 16 jointly housing said plurality of pump tubing-compressing idler rollers 7 in approximately equidistant radially disposed positions so that the circumferential faces of the pump tubing-compressing idler rollers 7 bear into the circumferential face of said axial cylindrical mid-section 16. For this purpose, the circumferential face of said axial cylindrical mid-section 16 has arcuate longitudinal recesses 17 corresponding to the number of pump tubing-compressing idler rollers 7 and conforming with the diameter of each said pump tubing-compressing idler roller 7 so that a non-substantial part of the circumferential face of each said pump tubing-compressing roller 7 bears against said axial cylindrical mid-section 16 and a substantial part of the circumferential face of each said pump tubing-compressing roller 7 protrudes into said race compartment.

FIGS. 1, 2, 6, 7 and 8 of the drawings show said first practical form of the preferred embodiment, in which the inner flange member 14 and the outer flange member 15 are integral with the axial cylindrical mid-section 16. The inner flange member 14 has approximately equidistant radially disposed recesses forming end-seating cavities 18 for inner ends of said plurality of pump tubing-compressing idler rollers 7. The outer flange member 15 has correspondingly approximately equidistant radially disposed apertures forming end-bearing openings 19 for outer ends of said plurality of pump tubing-compressing idler rollers 7. An outer end plate 20 is removably connected to the outer flange member by a screw 21 for retaining said plurality of pump tubing-compressing idler rollers 7 in said inner end-seating cavities 18 and said outer end-bearing openings 19. The opposite ends of each pump tubing-compressing roller 7 have a conical point 22, while the corresponding bearing faces of said inner end-seating cavities 18 and of the inner face of said outer end plate 20 are flat.

Figure 1:
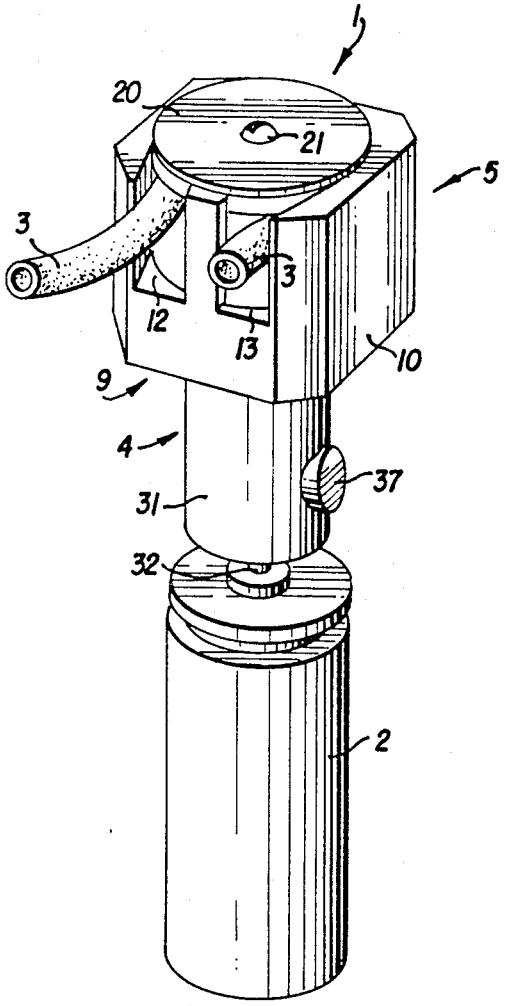
FIG. 1 is a perspective view of a pump assembly in operative relationship according to the present invention, in which the outer flange member is integral with the axial cylindrical mid-section of the rotor member circular head section, according to the first practical form of the preferred embodiment as indicated above.
Figure 2:
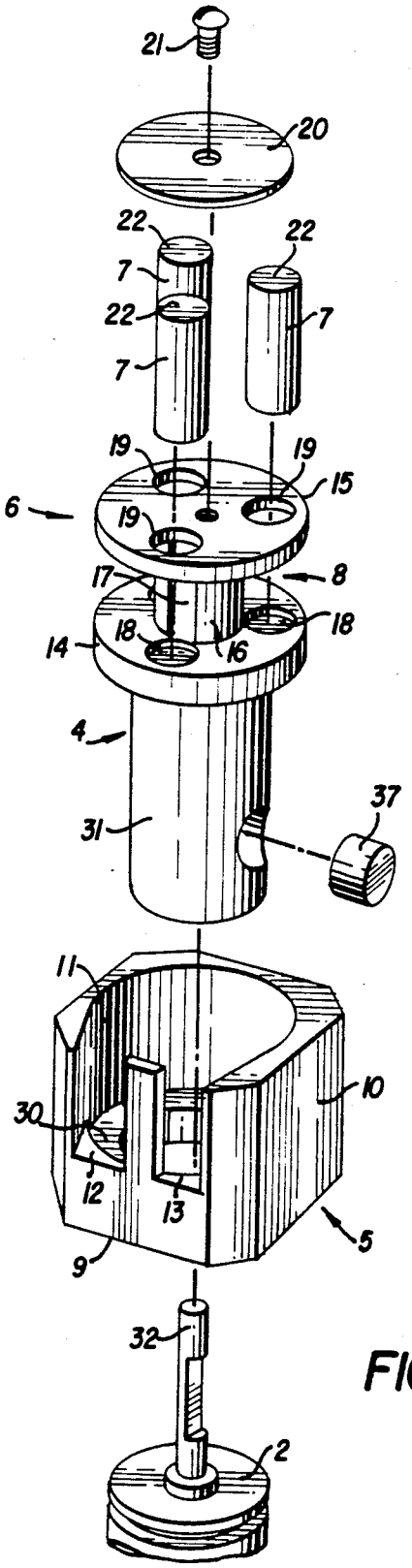
FIG. 2 is an exploded view of the components forming the pump assembly shown in FIG. 1, in non-operative relationship.
Figure 3:
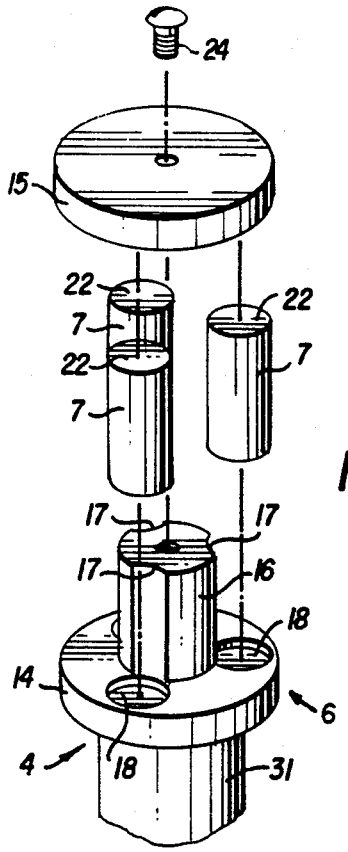
FIG. 3 is an exploded view of the components of the rotor member circular head section, in which the outer flange member is a disc member non-integral with the axial cylindrical mid-section of the rotor member circular head section, according to the second practical form of the preferred embodiment as indicated above.
Figure 4:
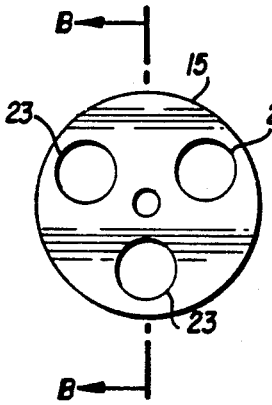
FIG. 4 is an inverted plan view of the non-integral outer flange member depicted in the embodiment of FIG. 3, principally showing the inner face of the non-integral outer flange member with radially disposed recesses for receiving the conically pointed outer ends of the pump tubing-compressing idler rollers.
Figure 5:
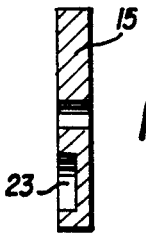
FIG. 5 is a cross-sectional view of the non-integral outer flange member taken at lines B—B of FIG. 4.
Figure 6:
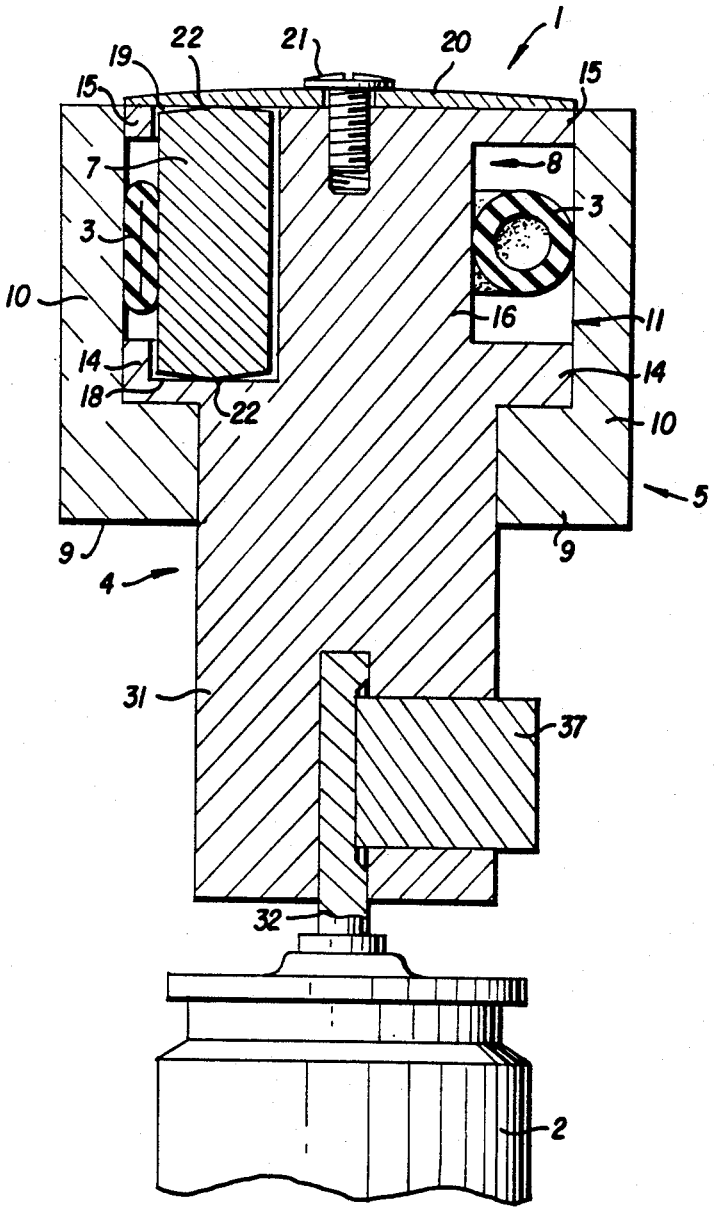
FIG. 6 is a part cross-sectional/part elevational view of the pump assembly according to the embodiment shown in FIGS. 1 and 2, in operative relationship.
Figure 7:
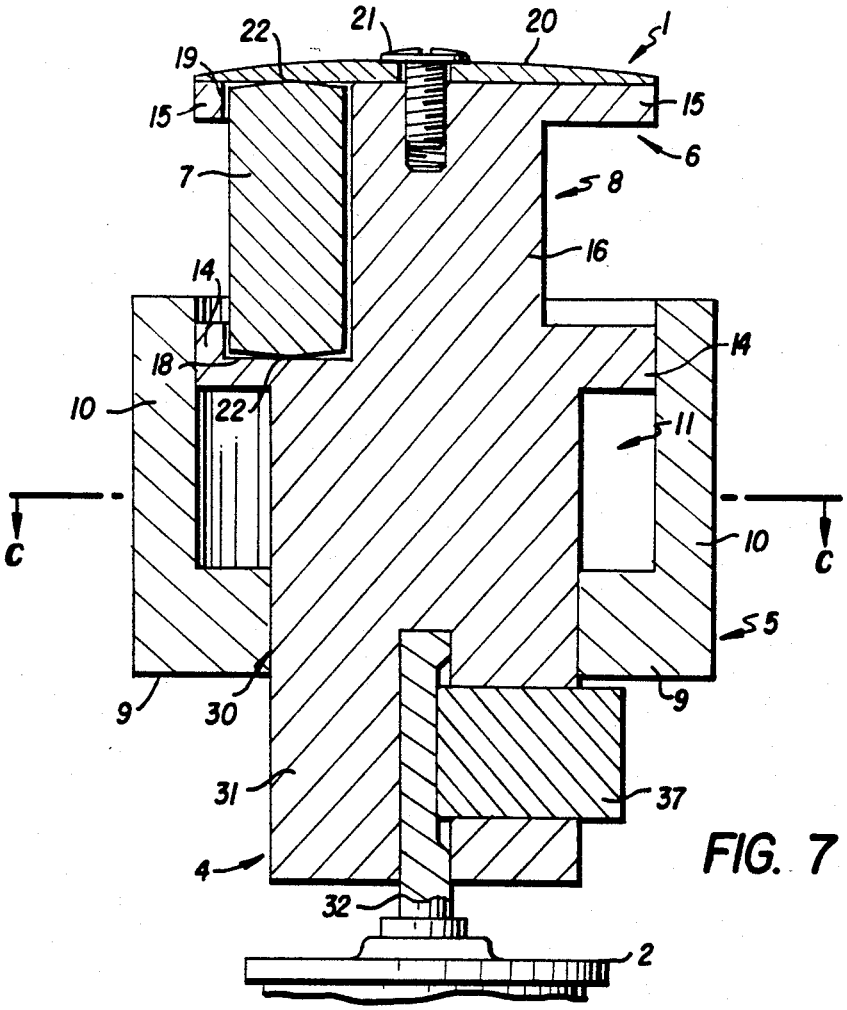
FIG. 7 is a part cross-sectional/part elevational view of the pump assembly according to the embodiment shown in FIGS. 1 and 2, in non-operative relationship, in which the rotor member is displaced axially for inspection/adjustment/removal/replacement of the pump tubing and/or the pump tubing-compression idler rollers.
Figure 8:
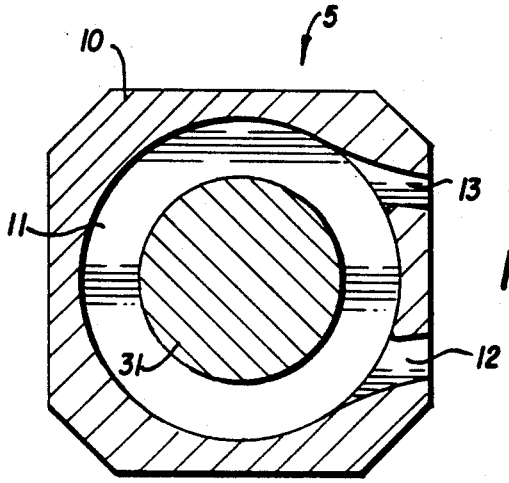
FIG. 8 is a cross-sectional view taken at line C—C of FIG. 7, on a reduced scale.

FIGS. 3, 4 and 5 of the drawings show said second practical form of the preferred embodiment, in which the inner flange member 14 is integral with the axial cylindrical mid-section 16 and the outer flange member 15 is a disc member non-integral with the axial cylindrical mid-section 16. The inner flange member 14 has approximately equidistant radially disposed recesses forming end-seating cavities 18 for inner ends of said plurality of pump tubing-compressing idler rollers 7. Said disc member has correspondingly approximately equidistant radially disposed recesses forming end-seating cavities 23 for outer ends of said plurality of pump tubing-compressing idler rollers 7. Said disc member is removably connected to said axial cylindrical mid-section 16 by screw 24 for retaining said plurality of pump tubing-compressing idler rollers 7 in the inner end-seating cavities 18 and the outer end-seating cavities 23. The opposite ends of each pump tubing-compressing roller 7 have a conical point 22 while corresponding bearing faces of the inner end-seating cavities 18 and the outer end-seating cavities 23 are flat.

FIGS. 9 and 10 of the drawings show the circular head section 6 of the rotor member 4 also housing a plurality of pump tubing-stabilizing idler rollers 25 in approximately equidistant radially disposed positions in between the approximately equidistant radially disposed positions of the pump tubing-compressing idler rollers 7 for idle rotation axially parallel to the axis of rotation of the rotor member in the course of rotation of said rotor member 4. A non-substantial part of the circumferential face of each pump tubing-stabilizing idler roller 25 protrudes into said race compartment whereby the portion of the pump tubing 3 in said race compartment is successively contacted by the protruding circumferential faces of the pump tubing-stabilizing idler rollers 25 in the course of rotation of said rotor member 4. The pump tubing 3 is thereby frictionally restrained between said inner face of the stator member wall section 10 and said circumferential faces of the pump tubing-stabilizing idler rollers 25 to counter a tendency of the pump tubing 3 to move within said race compartment. The circumferential face of each pump tubing-stabilizing idler roller 25 has a concave contour substantially corresponding to the diameter of the pump tubing 3 to minimise distortion of the pump tubing.

In this case, in addition to the circumferential face of said axial cylindrical mid-section 16 having the arcuate longitudinal recesses 17 corresponding to the number of pump tubing-compressing idler rollers 7 and conforming with the diameter of each said pump tubing-compressing idler roller 7 so that a non-substantial part of the circumferential face of each said pump tubing-compressing roller 7 bears against said axial cylindrical mid-section 16 and a substantial part of the circumferential face of each said pump tubing-compressing roller 7 protrudes into said race compartment, the circumferential face of said axial cylindrical mid-section 16 also has arcuate longitudinal recesses 26 corresponding to the number of pump tubing-stabilizing idler rollers 25 and conforming with the diameter of each said pump tubing-stabilizing roller 25, so that a substantial part of the circumferential face of each pump tubing-stabilizing roller 25 bears against said axial cylindrical mid-section 16, and a non-substantial part of the circumferential face of each pump tubing-stabilizing roller 25 protrudes into said race compartment.

Also in this case, the inner flange member 14 has approximately equidistant radially disposed recess forming end-seating cavities 27 for inner ends of said plurality of pump tubing-stabilizing idler rollers 25. The outer flange member 15 is shown integral with the axial cylindrical mid-section 16 and has correspondingly approximately equidistant radially disposed apertures forming end-bearing openings 28 for outer ends of said plurality of pump tubing-stabilizing idler rollers 25. The outer end plate 20, removably connected to the outer flange member 15 by the screw 29, retains said plurality of pump tubing-stabilizing idler rollers 25 and said pump tubing-compressing idler rollers, in said inner end-seating cavities 27 and said outer end-bearing openings 28. The opposite ends of each pump tubing-stabilizing roller 25 has a conical point 22, similar to the opposite ends of each pump tubing-compressing roller 7, the corresponding bearing faces of said inner end-seating cavities 27 and of said outer end plate 20 being flat.

The rotor member 4 is slideably fitted to the stator member 5 so as to be displaceable axially of the stator member 5 through a coaxial opening 30 in said base section 9 of the stator member 5 for accommodating a drive shaft section 31 of the rotor member 4. The length of said drive shaft section 31 is such that the rotor member 4 can be displaced axially of the stator member 5 sufficiently to give access to the pump tubing-compressing idler rollers 7 and the pump tubing-stabilizing idler rollers 25, if utilized, and the part of the pump tubing 3 in said race compartment, for inspection and/or adjustment and/or replacement of any of said idler rollers and the pump tubing. In the practical form of pump assembly illustrated in FIGS. 1 to 8 of the drawings, the drive shaft section 31 of the rotor member 4 is directly connected to the motor drive means shaft 32, while in the practical form of pump assembly illustrated in FIGS. 9 and 10 of the drawings, the drive shaft section 31 of the rotor member 4 is indirectly connected to the motor drive means shaft 32, the drive connected to the motor drive means 2 by motor drive means shaft 32, in both forms.

In the practical form of pump assembly illustrated in FIGS. 9 and 10; the drive shaft section 31 of the rotor member 4 comprises a torque transfer member in the form of a cylinder 33 removably connected to the motor drive means shaft 32. Cylinder 33 has an axially disposed spindle 34 adapted to be inserted into a corresponding axially disposed cavity 35 in the circular head section 6 of the rotor member 4 for removable connection of the torque transfer member to said circular head section 6 by screw 29, with screw 36 further removably fastening cylinder 33 to drive shaft section 31 of the rotor member 4.

In the practical form of pump assembly illustrated in FIGS. 1 to 8, in which the drive shaft section 31 is directly connected to the motor drive means shaft 32, a magnet 37 is incorporated in said drive shaft section 31 for position-sensing in conjunction with suitable means statically mounted for accurate metering and control of delivered volume, and for limitation of axial movement of said rotor member 4 to prevent disassembly during replacement of pump tubing 3, and for axial and angular location of the motor drive means shaft 32 into said drive shaft section 31 of the rotor member 4.

In the practical form of pump assembly illustrated in FIGS. 9 and 10, in which the drive shaft section 31 is indirectly connected to the motor drive means shaft 32, the magnet 37 is incorporated in a torque transfer member or cylinder 33 connected to drive shaft section 31 for position-sensing in conjunction with suitable means statically mounted (eg. on stator member 5) for accurate metering and control of delivered volume, and for limitation of axial movement of the rotor to prevent disassembly during replacement of pump tubing. In this case, axial and angular location of the motor drive means shaft 32 in relation to the drive shaft section 31 of the rotor member 4 is effected by grub screw 38.

FIG. 11 exemplifies electronic control circuitry for the pump of the invention, in consisting of a simple driving circuit for intermittent operation using standard CMOS gate technology. In FIG. 11, A=NAND Gate: ¼ of MM74COO; B=Inverter: 1/6 of MM74CO4; C=Positive Supply 10 Volts; D=Earth; E=D.C. Motor: Faulhaber 1616EO24S (with 16/3 900:1 gearbox); $R_1$=820 K ohm; $R_2$=47 K ohm; $R_3$=10 M ohm; $R_4$=10 K ohm; $R_5$=1 M ohm; $C_1$=0.1 mfd; $C_2$=0.01 mfd; $C_3$=0.1 mfd; OSC=Oscillator; FD=MM 5369 Frequency Divider; FF=Flip-Flop; PA=Post Amplifier; and RS=Reed Switch. This circuit causes the pump to deliver a bolus of 0.01–0.05 ml., depending on tubing size, every 2 hours. The current drawn is only a few microamperes between pulses.

Construction of the individual components of a pump in accordance with the invention and the functions of those components can be described in the following terms: Rotor Member—This component, which can be machined from a block of PTFE, embodies several functional elements as follows, with particular reference to FIGS. 1, 2, 6, 7 and 8 of the drawings: (i) the rotor shaft, which fits into the bearing element of the stator member in which it rotates, absorbing any radial force resulting from either misalignment of the motor drive shaft or from the assymetrical loading of the pump tubing-compressing idler rollers, though this is largely absorbed by the outer faces of the flanges, the rotor shaft also permitting axial movement in the bearing for change of pump tubing; (ii) flanges, which result from the machining of the circumferential recess for the pump tubing, with (a) inner faces restricting axial movement of the pump tubing in the circumferential recess, and (b) a lower face which bears on the thrust bearing surface of the stator member, and (c) outer faces, which bear on the race compartment between the rotor and stator members, absorbing the radial force resulting from the assymetrical loading of the pump tubing-compressing idler rollers; (iii) idler roller cavities, which are cylindrical with axes parallel to the axis of the rotor member, and are approximately 10% wider in diameter than the idler rollers, the radial distance "d" between the central surface of each cavity and the outer faces of the flange being given by the expression $d=1.90(r+w)$, where "r" is the radius of roller and "w" is the wall thickness of the pump tubing; and (iv) an upper end face, which has the rotor end plate fixed thereto after insertion of the rollers in the roller cavities.

Idler Rollers—These components can be cut from PTFE rod to the length of the cavities, and have their ends chamfered to conical points so as to reduce the contact area with the bottom of each cavity and the end plate, respectively. They rotate within their cavities by rolling against the pump tubing, due to rotation of the rotor member during operation of the pump, thereby to exert pressure on the pump tubing for peristaltic pumping of fluid therein.

End Plate—This component is a thin disc of "Delrin" or PTFE, which is removably fixed to the upper end face of the rotor member to retain the idler rollers and to act as a thrust surface to prevent the rotor member advancing from the stator member during normal operation.

Stator Member—This component, which can be machined from a single block of "Delrin" polyacyl or from a single block of polycarbonate, since both these materials are of adequate tensile strength to withstand the radial force exerted by the pump tubing-compressing idler rollers via the pump tubing (the idler rollers having sufficient sliding friction with respect to silicone rubber to prevent the pump tubing being drawn through the pump during operation), embodies several functional elements as follows: (i) a bearing into which fits the shaft of the rotor member, (ii) a race compartment which has the functions of (a) a bearing in which the flanges run, and (b) a surface against which the pump tubing is compressed by the pump tubing-compressing idler rollers; (iii) a thrust bearing which supports the lower face of the flanges; (iv) entry/exit ports which carry the pump tubing tangentially into and out of the race compartment and are disposed at such an angle with respect to each other that as one pump tubing-compressing idler roller arrives at one side of the junction of the pump tubing entry port and the race compartment, the previous pump tubing-compressing idler roller departs from the other side, which action increases smoothness of operation, decreases peak power requirements, and avoids any tendency for the rotor to jump backwards or forwards when the power is switched off; and (v) a thrust base which fits against a clip in the pump case, lightly holding the pump head assembly against a rounded protuberance of a pump enclosure case (not shown in the drawings) which bears against the centre of the end plate.

Assembly and operation of the pump of the invention, when utilized as a medical drug infusion pump, can be described as follows:

Driving Mechanism—The shaft of the rotor member is mounted on the motor drive output shaft of a D.C. micomotor/gearbox assembly with a reaction ratio of approximately 900:1. A typical current requirement is 7 milliamperes at 5 volts. This is conveniently supplied by a mercury battery via a suitable control circuit as described above. A reed switch is also mounted on the gearbox casing in such a position that it is affected by the field of the magnet as the magnet rotates with the shaft of the rotor member and so can detect movement of the shaft.

Pump Tubing Loading—The pump head assembly is swung clear of the clip and protuberance in the pump enclosure case (not shown in the drawings). The stator member is then pushed axially towards the motor until it is stopped by the magnet. This exposes the circumferential recess in the rotor head section around which the pump tubing is passed. The ends of the tubing are pulled tightly down into the pump tubing entry/exit ports, and the stator member is at the same time drawn back, away from the motor. The pump assembly is then clipped back into the pump enclosure case. Should it be desired to shorten one end of the pump tubing, for example in order to bring the medical drug reservoir of a miniature reservoir/pump tubing assembly up against the pump head, this can be achieved by gentle traction on the distal end of the pump tubing.

Normal Operation—Each pump tubing-compressing idler roller passing the pump tubing entry port by the rotation of the rotor member, compresses the pump tubing, thus occluding the lumen. As the rotor member continues to rotate, each pump tubing-compressing idler roller moves along the pump tubing, pushing the contents of the tubing ahead. By the time each pump tubing-compressing idler roller reaches the pump tubing exit port, the succeeding pump tubing-compressing idler roller has already occluded the lumen behind it, so that liquid cannot escape back towards the inlet, and pumping continues.

The version of pump illustrated in FIGS. 1 to 8 is designed to work with a range of commercially available silicone rubber tubing giving flows of 0.01–0.05 ml. per revolution. The accuracy using the magnet and reed-switch sensor and Dow Corning medical grade silastic tubing is typically 2%.

The flow is pulsatile, hence the relative positions of reed switch and magnet are adjusted so that the switch closes just before a pump tubing-compressing idler roller arrives at the junction of said pump tubing inlet port and said race compartment. This ensures that in intermittent operation, blood is not sucked back into the tip of an intravascular cannula at the end of a pulse.

I claim:

1. A rotary peristaltic pump adapted to be fitted with motor drive means and pump tubing for connection to a source of fluid, said pump comprising:

a rotor member adapted for operative coupling to the motor drive means and having a circular head section housing a plurality of pump tubing-compressing idler rollers in approximately equidistant radially disposed positions for idle rotation axially parallel to the axis of rotation of the rotor member in the course of rotation of said rotor member, said circular head section having an inner flange member and an outer flange member joined in spaced-apart relationship by an axial cylindrical mid-section so as to form a circumferential recess defining a race compartment of the pump tubing-compressing idler rollers, said pump tubing-compressing idler rollers positioned between said inner flange member and outer flange member for idle rotation axially parallel to the axis of rotation of the rotor member by the opposite ends of each said pump tubing-compressing idler roller engaging in recess bearings in the inner flange member and outer flange member respectively, and a minor portion of the circumferential face of each said pump tubing-compressing idler roller disposed in an axially parallel idler roller thrust-bearing groove in the circumferential face of said axial cylindrical mid-section, with the major portion of the circumferential face of each pump tubing-compressing idler roller protruding into said race compartment; and a stator member having a base section and a wall section with inner faces which define an axial opening for accommodating the circular head section of the rotor member and having pump tubing entry and exit ports in the wall section for tangential communication with said race compartment of the rotor member;

said pump tubing being fitted to the pump by loading into the race compartment via said pump tubing entry port, then passing around the race compartment to exit therefrom via said pump tubing exit port, whereby the portion of the pump tubing in said race compartment is successively contacted by the protruding circumferential faces of the pump tubing-compressing idler rollers in the course of rotation of said rotor member so as to be compressed between said inner face of the stator member wall section and said circumferential faces of the pump tubing-compressing idler rollers for effective peristaltic pumping of fluid in said pump tubing, and the circumferential faces of the pump tubing-compressing idler rollers engaging the axially parallel roller thrust-bearing grooves in the circumferential face of the axial cylindrical mid-section so as to minimize axial flexural deformation of each pump tubing-compressing idler roller induced by compression of the pump tubing.

2. A rotary peristaltic pump according to claim 1 wherein said rotor member is slideably displaceable axially but not radially of the stator member through a co-axial bearing in said base section of the stator member for accomodating a drive shaft bearing section of the rotor member, the length of said drive shaft bearing section being such that the rotor member can be displaced axially of the stator member sufficiently to give access to the pump tubing-compressing idler rollers and the part of the pump tubing in said race compartment for inspection and pump tubing adjustment and pump tubing replacement.

3. A rotary peristaltic pump according to claim 1 wherein the circumferential face of said axial cylindrical mid-section has said axially parallel arcuate grooves corresponding to the number of pump tubing-compressing idler rollers and conforming with the diameter of each said pump tubing-compression idler roller for the minor portion of the circumferential face of each said pump tubing-compressing roller to engage and bear against said axial cylindrical mid-section, with the major portion of the circumferential face of each said pump tubing-compressing roller protruding into said race compartment.

4. A rotary peristaltic pump according to claim 1 wherein the inner flange member and the outer flange member are integral with the axial cylindrical mid-section, the inner flange member having approximately equidistant radially disposed recesses forming end-seating cavities for inner ends of said plurality of pump tubing-compressing idler rollers, the outer flange member having corresponding approximately equidistant radially disposed apertures forming end-bearing openings for outer ends of said plurality of pump tubing-compressing idler rollers, and an outer end plate removably connected to the outer flange member for retaining said plurality of pump tubing-compressing idler rollers in said inner end-seating cavities and said outer end-bearing openings.

5. A rotary peristaltic pump according to claim 4 wherein the opposite ends of each pump tubing-compressing roller are conically pointed, and the corresponding bearing faces of said inner end-seating cavities and of said outer end plate are flat.

6. A rotary peristaltic pump according to claim 1 wherein the inner flange member is integral with the axial cylindrical mid-section and the outer flange member is a disc member non-integral with the axial cylindrical mid-section, the inner flange member having approximately equidistant radially disposed recesses forming end-seating cavities for inner ends of said plurality of pump tubing-compressing idler rollers, the disc member having corresponding approximately equidistant radially disposed recesses forming end-seating cavities for outer ends of said plurality of pump tubing-compressing idler rollers, and said disc member being removably connected to said axial cylindrical mid-section for retaining said plurality of pump tubing-compressing idler rollers in said inner end-seating cavities and said outer end-seating cavities.

7. A rotary peristaltic pump according to claim 6 wherein the opposite ends of each pump tubing-compressing roller are conically pointed and corresponding bearing faces of said inner end-seating cavities and said outer end-seating cavities are flat.

8. A rotary peristaltic pump according to claim 1 wherein said inner flange member and outer flange member and axial cylindrical mid-section of the circular head section of the rotor member also house a plurality of pump tubing-stabilizing idler rollers in approximately equidistant radially disposed positions in between the approximately equidistant radially disposed positions of the pump tubing-compressing idler rollers also for idle rotation axially parallel to the axis of rotation of the rotor member in the course of rotation of said rotor member, said pump tubing-stabilizing idler rollers positioned between said inner flange member and outer flange member for idle rotation axially parallel to the axis of rotation of the rotor member by the opposite ends of each said pump tubing-stabilizing idler roller engaging in recess bearings in the inner flange member and outer flange member respectively, and a major portion of the circumferential face of each said pump tubing-stabilizing idler roller disposed in an axially parallel roller thrust-bearing groove in the circumferential face of said axial cylindrical mid-section, with the minor portion of the circumferential face of each said pump tubing-stabilizing idler roller protruding into said race compartment, whereby the portion of the pump tubing in said race compartment is successively contacted by the protruding circumferential faces of the pump tubing-stabilizing idler rollers in the course of rotation of said rotor member so as to be frictionally restrained between said inner face of the stator member wall section and said circumferential faces of the pump tubing-stabilizing idler rollers for countering a tendency of the pump tubing to move within said race compartment.

9. A rotary peristaltic pump according to claim 8 wherein the circumferential face of said axial cylindrical mid-section has said axially parallel arcuate grooves corresponding to the number of pump tubing-compressing idler rollers and conforming with the diameter of each said pump tubing-compressing idler roller so that a minor portion of the circumferential face of each said pump tubing-compressing roller bears against said axial cylindrical mid-section and a major portion of the circumferential face of each said pump tubing-compressing roller protrudes into said race compartment, and the circumferential face of said axial cylindrical mid-section also has axially parallel arcuate grooves corresponding to the number of pump tubing-stabilizing idler rollers and conforming with the diameter of each said pump tubing-stabilizing roller so that a major portion of the circumferential face of each said pump tubing-stabilizing roller bears against said axial cylindrical mid-section and a minor portion of the circumferential face of each said pump tubing-stabilizing roller protrudes into said race compartment.

10. A rotary peristaltic pump according to claim 8 wherein the inner flange member and the outer flange member are integral with the axial cylindrical mid-section, the inner flange member having approximately equidistant radially disposed recesses forming end-seating cavities for inner ends of said plurality of pump tubing-compressing idler rollers and for inner ends of said plurality of pump tubing-stabilizing idler rollers, the outer flange member having corresponding approximately equidistant radially disposed apertures forming end-bearing openings for outer ends of said plurality of pump tubing-compressing idler rollers and for outer ends of said plurality of pump tubing-stabilizing idler rollers, and an outer end plate removably connected to the outer flange member for retaining said plurality of pump tubing-compressing idler rollers and pump tubing-stabilizing idler rollers in said inner end-seating cavities and said outer end-bearing openings.

11. A rotary peristaltic pump according to claim 10 wherein the opposite ends of each pump tubing-compressing roller and each pump tubing-stabilizing roller are conically pointed and corresponding bearing faces of said inner end-seating cavities and of said outer end plate are flat.

12. A rotary peristaltic pump according to claim 8 wherein the inner flange member is integral with the axial cylindrical mid-section and the outer flange member is a disc member non-integral with the axial cylindrical mid-section, the inner flange member having approximately equidistant radially disposed recesses forming end-seating cavities for inner ends of said plurality of pump tubing-compressing idler rollers and for inner ends of said plurality of pump tubing-stabilizing idler rollers, the disc member having corresponding approximately equidistant radially disposed apertures forming end-bearing openings for outer ends of said plurality of pump tubing-compressing idler rollers and for outer ends of said plurality of pump tubing-stabilizing idler rollers, and said disc member being removably connected to said axial cylindrical mid-section for retaining said plurality of pump tubing-compressing idler rollers and pump tubing-stabilizing idler rollers in said inner end-seating cavities and said outer end bearing openings.

13. A rotary peristaltic pump according to claim 12 wherein the opposite ends of each pump tubing-compressing roller and each pump tubing-stabilizing roller are conically pointed and corresponding bearing faces of said inner end-seating cavities and said outer end-seating cavities are flat.

14. A rotary peristaltic pump according to claim 8 wherein the circumferential face of each pump tubing-stabilizing idler roller has a concave contour substantially corresponding to the diameter of the pump tubing.

15. A rotary peristaltic pump according to claim 1 wherein the drive shaft section of the rotor member which is directly connected to said motor drive means.

16. A rotary peristaltic pump according to claim 15 wherein a magnet is incorporated in the drive shaft section of the rotor member for position-sensing in conjunction with means statically mounted for accurate metering and control of delivered volume, and for limitation of axial movement of said rotor member to prevent disassembly during replacement of pump tubing, and for axial and angular location of a motor drive means shaft into said drive shaft section of the rotor member.

17. A rotary peristaltic pump according to claim 1 wherein the drive shaft section of the rotor member is directly connected to said motor drive means.

18. A rotary peristaltic pump according to claim 17 wherein a magnet is incorporated in the drive shaft section of the rotor member for position-sensing in conjunction with means statically mounted for accurate metering and control of delivered volume, and for limitation of axial movement of the rotor member to prevent disassembly during replacement of pump tubing.

19. A rotary peristaltic pump according to claim 17 wherein the drive shaft section of the rotor member comprises a torque transfer member removably connected to the circular head section of the rotor member and removably fitted to a motor drive means shaft.

20. A rotary peristaltic pump according to claim 19 wherein the torque transfer member of said drive shaft section of the rotor member is in the form of a cylinder having an axially disposed spindle and adapted for removable connection to said motor drive means shaft and for removable connection to said drive shaft section of the rotor member, said axially disposed spindle adapted to be inserted into a corresponding axially disposed cavity in the circular head section of the rotor member for removable connection of the torque transfer member to said circular head section.

* * * * *